United States Patent [19]

Roller

[11] 4,101,760

[45] Jul. 18, 1978

[54] REFRACTORY GRANULAR EMBEDDING COMPOSITION FOR ELECTRIC HEATING COILS

[75] Inventor: Hanno Roller, Kandel, Pfalz, Germany

[73] Assignee: Firma Fritz Eichenauer, Germany

[21] Appl. No.: 673,527

[22] Filed: Apr. 5, 1976

[30] Foreign Application Priority Data

Apr. 3, 1975 [DE] Fed. Rep. of Germany ..... 2514578

[51] Int. Cl.[2] ..... H01B 3/46; H01B 3/12; H05B 3/48; H05B 3/18

[52] U.S. Cl. ..... 219/544; 174/118; 219/548; 252/63.2; 252/63.5; 252/63.7; 252/194; 338/238

[58] Field of Search ..... 252/63.2, 63.5, 63.7, 252/194; 219/548, 544; 338/238; 174/118

[56] References Cited

U.S. PATENT DOCUMENTS

| | | | |
|---|---|---|---|
| 2,669,636 | 2/1954 | Rawles | 252/63.2 X |
| 2,684,428 | 7/1954 | Bixler | 338/238 |
| 2,802,896 | 8/1957 | Tierman et al. | 252/63.2 |
| 3,726,713 | 4/1973 | Hawk et al. | 174/118 X |

*Primary Examiner*—Harris A. Pitlick
*Attorney, Agent, or Firm*—Craig and Antonelli

[57] ABSTRACT

A refractory, granular electrically insulative composition useful as an embedding composition for electric heating coils comprises fused and granulated, possibly ground, difficultly fusible, ceramic and possibly oxide-ceramic material having polyalkylsiloxane, e.g. polymethylsiloxane, or polyarylsiloxane admixed in a proportion of from 0.5 to 5.0% added weight. Use of the composition is suitable with tubular heaters which have been produced with it and which, after manufacture and before being brought into use, have been subjected to a heat treatment at a temperature of at least 65° C, for a period of at least 10 minutes. An electrical heating element comprises a housing which is embedded in the composition wherein the ceramic and possibly oxide-ceramic material has been ground.

15 Claims, No Drawings

REFRACTORY GRANULAR EMBEDDING COMPOSITION FOR ELECTRIC HEATING COILS

The present invention relates to a refractory, granular electrically insulative composition suitable for use as an embedding composition for electric heating coils, advantageously for use with metal-covered electrical heater elements, more especially electrical tubular heaters; a method of use of such a composition; and an assembly of such a composition and an electrical heating element embedded therein.

Metal-covered electrical heating elements are used for heating liquids in baths, for contact heating in cast or poured metals and for heating gaseous media. Conventional tubular heaters have an external, metallic tubular wall with a diameter which is greater than 6 mm, with a maximum of 8.5 mm, a heating coil of metallic resistance material being disposed in centred relation on the mean axis of the tubular wall. The interstice is filled with a ceramic or oxide-ceramic, small-grain insulating composition, advantageously fused magnesium oxide. The quality thereof as regards transfer of heat and electrical properties is mainly dependent on the electric, insulating embedding composition which has been introduced between the heating coils and the tubular wall. The fused magnesium oxide which is usually employed for this purpose has an excellent thermal conductivity and at the same time high electrical resistivity. The optimal values for the thermal conductivity and the electrical resistivity are obtained with a final consolidation of the magnesium oxide of 3.1 to 3.2 g/ml.

Insulating compositions have been previously proposed wherewith the electrically fused and thereafter ground magnesium oxide has additives admixed therewith in order to improve the electrical properties at high operating temperatures. Such compositions are very efficient, but they only completely satisfy the purpose for which they are intended if the ends of the tubular heaters are sealed in such a way that no moisture is able to penetrate into the magnesium oxide. Several constructional forms have been previously proposed for the water-tight sealing of tubular heaters. For example, constructions have been previously proposed wherein elastic sockets or nozzles are introduced into the open tubular heaters and are so compressed by means of a tool that moisture is no longer able to penetrate into the end of the tubular heater. It is also known to introduce a plastics or a liquid composition into an open end of a tube and then to provide a seal in the form of a tubular sleeve of silicone rubber, ceramics or PTFE (Teflon - Registered Trade Mark), which then is likewise subsequently fixed in position in such a way that any emergence thereof from the end of the tubular heater is prevented. With these insulating compositions and such tube seals, additional working steps are necessary in the manufacture of an electrical tubular heater, which involve a considerable additional expense for material as well as the time which is involved. Despite this additional expense in the manufacture of such known heater elements, the possibility of moisture being able to penetrate into the open ends of the tubes immediately after an annealing operation is not reliably excluded. Since the magnesium oxide has the property of being quite hygroscopic, a danger constantly exists of moisture being absorbed, and then electrical values, more especially the resistance of the electrical insulation, can decrease strongly and a discharge current can rise to impermissible orders of magnitude.

It is an object of the present invention to provide a refractory, granular insulating composition suitable for use as an embedding composition for electric heating coils, wherein the above-indicated disadvantages are eliminated or substantially reduced.

According to the present invention, therefore, we provide a refractory, granular electrically insulative composition suitable for use as an embedding composition for electric heating coils, which composition comprises fused and granulated, difficultly fusible, ceramic material having polyalkylsiloxane or polyarylsiloxane admixed therewith in a proportion of from 0.5 to 5.0% by weight, expressed as an added weight, based on the total weight of the ceramic material and fused and granulated, difficultly fusible, oxide-ceramic material.

We have established by tests that the addition of polyalkylsiloxanes or polyarylsiloxanes to the remainder of the present composition results in a considerable improvement thereof as regards the absorption of moisture and therefore also have a favourable influence on the electrical properties thereof.

In a preferred embodiment of the present composition, it comprises fused and granulated, difficultly fusible, oxide-ceramic material.

The polyalkylsiloxane preferably comprises polymethylsiloxane.

The polyalkylsiloxanes or polyarylsiloxanes, have preferably been admixed in a grain size from 20 to 200 $\mu$ with the remainder of the present composition.

Particularly preferred results are obtained, when the present composition is in use, when the ceramic material and, where present, the oxide-ceramic material, comprise a high-melting metal oxide, preferably magnesium oxide, beryllium oxide, titanium dioxide, or silicon dioxide, or a mixture thereof.

In place thereof, it is, however, also preferable that the ceramic material comprise a ceramic silicate material, for example of clay.

According to a further feature of the present invention, we provide a method of use of a composition as defined above, in which method tubular heaters which have been produced with the composition, after manufacture and before being brought into use, have been subjected to a heat treatment at a temperature of at least 65° C for a period of at least 10 minutes. This heat treatment can essentially be omitted if the manufactured tubular heater, as is usually the case, has to be subjected in any case to an annealing treatment at relatively high temperature for other reasons, for example, for eliminating material stresses, but the present method has proved to be necessary to maintain the resistance to moisture of the tubular heaters in the method.

According to a still further feature of the present invention, we provide an electrical heating element comprising a housing which is embedded in a composition as defined above wherein the ceramic material or the oxide-ceramic material has been ground.

The following Example illustrates the present composition.

EXAMPLE

Several heating elements were produced with which polymethylsiloxane had been admixed, in each case in a proportion between 0.5 and 5.0%, expressed as an added weight, based on the total weight of a composition comprising fused and granulated, difficultly fusible, ceramic and possibly oxide-ceramic material. The heating elements consisted of a tubular wall made of steel (St 3402), the embedding composition comprising essentially magnesium oxide as a basic composition and modified as indicated above and an electrical resistance element of a nickel-chrome alloy in the ratio of 4.1 (by weight). The embedding composition when poured in was compressed to a density of approximately 3.2 g/ml by reduction of the cross-sectional area of the tubular wall. The specific surface loading for the heating element was 2.1 watt/ml.

After the cross-sectional area of the tubular wall had been reduced, the elements were annealed at a temperature of 800° C in a reducing atmosphere. The ends of the tubular heaters were not closed. The measurement of the electrical resistance with a direct current of 500 volt show a value greater than $10^4$ MΩ. Heating elements produced for comparison and without any addition of polymethylsiloxane to the embedding composition had the same electrical resistances immediately after manufacture.

After storage for 72 hours in a moist chamber at 90% relative humidity and at 30° C, an electrical resistance of greater than $10^4$Ω was measured, showing no change, with the tubular heaters having the present embedding composition. The comparison heaters without any addition to the basic composition had fallen in value to less than 0.3 MΩ after being kept for 8 hours in the moist chamber. After being stored for 144 hours and after 262 hours in the said chamber, the measured electrical resistance of the tubular heaters, with polymethylsiloxane added to the embedding composition, was always still greater than $10^4$ MΩ.

I claim:

1. A refractory, granular, electrically-insulative composition suitable for use as an embedding composition for electric heating coils, which composition comprises fused and granulated, high-melting, ceramic material having solid granulated polyalkylsiloxane or polyarylsiloxane admixed therewith in a proportion of from 0.5 to 5.0% by weight, expressed as an added weight, based on the weight of the ceramic material.

2. A composition according to claim 1 wherein said ceramic material comprises oxide-ceramic material.

3. A composition according to claim 2, wherein the oxide-ceramic material is a high-melting metal oxide.

4. A composition according to claim 3, wherein the high-melting metal oxide is magnesium oxide, beryllium oxide, titanium dioxide, or silicon dioxide, or a mixture thereof.

5. A composition according to claim 4 wherein the high-melting metal oxide is magnesium oxide.

6. A composition according to claim 1, wherein the ceramic material has been ground.

7. A composition according to claim 1, wherein the polyalkylsiloxane comprises polymethylsiloxane.

8. A refractory, granular, electrically-insulative composition suitable for use as an embedding composition for electric heating coils, which composition comprises fused and granulated, high-melting, ceramic material having solid granulated polymethylsiloxane having a grain size of from 20 μ to 200 μ admixed therewith in a proportion of from 0.5 to 5.0% by weight, expressed as an added weight, based on the weight of the ceramic material.

9. A composition according to claim 8, wherein the ceramic material comprises a silicate ceramic material.

10. A composition according to claim 8 wherein the ceramic material comprises magnesium oxide.

11. A method of using a refractory, granular, electrically-insulative composition as an embedding composition for an electric heating coil in a tubular heater, which composition comprises fused and granulated, high-melting ceramic material having solid granulated polyalkylsiloxane or polyarylsiloxane admixed therewith in a proportion of from 0.5 to 5.0% by weight, expressed as an added weight, based on the total weight of the ceramic material comprising subjecting said tubular heater containing said electric heating coil embedded in said composition to a heat treatment at a temperature of at least 65° C, for a period of at least 10 minutes.

12. A method of using a refractory, granular, electrically-insulative composition as an embedding composition for an electric heating coil in a tubular heater, which composition comprises fused and granulated, high-melting magnesium oxide having solid granulated polymethylsiloxane having a grain size of from 20μ to 200μ admixed therewith in a proportion of from 0.5 to 5.0% by weight, expressed as an added weight, based on the total weight of magnesium oxide comprising subjecting said tubular heater containing said electric heating coil embedded in said composition to a heat treatment at a temperature of at least 65° C, for a period of at least 10 minutes.

13. An electrical heating element comprising a housing and an electric heating coil which is embedded in a refractory, granular, electrically-insulative composition contained within said housing which composition comprises fused and granulated, high-melting, ceramic material having solid granulated polyalkylsiloxane or polyarylsiloxane admixed therewith in a proportion of from 0.5 to 5.0% by weight, expressed as an added weight, based on the total weight of the ceramic material.

14. An electrical heating element according to claim 3 wherein said polyalkylsiloxane is a polymethylsiloxane having a grain size of from 20μ to 200μ and said ceramic material is magnesium oxide.

15. A refractory, granular electrically insulative composition suitable for use as an embedding composition for electric heating coils, which composition consists essentially of fused and granulated, high-melting magnesium oxide having a solid granulated polymethylsiloxane with a grain size of from 20μ to 200μ admixed therewith in a proportion of from 0.5 to 5.0% by weight, expressed as an added weight, based on the weight of the magnesium oxide.

* * * * *